United States Patent [19]

Schirneker

[11] 4,185,953

[45] Jan. 29, 1980

[54] CANDLE LAMP WITH CARRIER WICK

[76] Inventor: Hans L. Schirneker, Engelslit 10, 4773, Mohnesee-Vollinghausen, Fed. Rep. of Germany

[21] Appl. No.: 883,095

[22] Filed: Mar. 3, 1978

[30] Foreign Application Priority Data

| | | | |
|---|---|---|---|
| Mar. 3, 1977 | [DE] | Fed. Rep. of Germany | 2709170 |
| Aug. 20, 1977 | [DE] | Fed. Rep. of Germany | 2737652 |
| Sep. 17, 1977 | [DE] | Fed. Rep. of Germany | 2742017 |

[51] Int. Cl.[2] ..... F23D 3/16

[52] U.S. Cl. ..... 431/291; 431/289; 431/320; 362/163

[58] Field of Search ..... 431/289, 291, 298, 310, 431/313, 320; 362/161, 162, 163

[56] References Cited

U.S. PATENT DOCUMENTS

| | | | |
|---|---|---|---|
| 397,011 | 1/1889 | Leynen-Hougaerts | 431/291 |
| 2,820,511 | 1/1958 | McCutchen | 431/313 |
| 3,790,332 | 2/1974 | Woollard | 431/291 |
| 3,958.917 | 5/1976 | Naz | 431/289 |

*Primary Examiner*—Carroll B. Dority, Jr.
*Attorney, Agent, or Firm*—Allison C. Collard; Thomas M. Galgano

[57] ABSTRACT

A lamp having a wick carrier which floats on the liquid fuel and carries one or more wicks partly immersed in the fuel, characterized by the feature that a bladed rotor is mounted on the wick carrier and is constructed and arranged to be axially or radially impacted by the thermal airflow of the lighted wick or wicks and to rotate the wick carrier.

17 Claims, 14 Drawing Figures

CANDLE LAMP WITH CARRIER WICK

The present invention relates to a lamp and especially a candle lamp having a wick carrier adapted to float on liquid fuel and which carrier has one or more, preferably non-combustible, wicks which, in use, are partially immersed in the fuel.

Candle toys are known in which a rotor is located above one or more stationary candles and the rotor is rotated above the candles by being axially impacted by thermal airflows of the flames at the wicks.

Candle lamps are known in which a heat-conducting wick carrier is embedded in a body of candle wax. As a result of heating by the candle flame, the wax below the wick carrier melts so that after a short time the arched wick carrier floats on the liquid fuel and the wick projects through the centre of the wick carrier into the wax body. Such a wick carrier sinks automatically with the comsumption of candle material. It has been found, however, that with such a wick carrier uniform comsumption cannot be obtained with a constant height of flame.

It is also known to provide a container with a wax filling in which an annular wick carrier is provided which retains several wicks. The wick carrier in this candle lamp also subsides with the liquid fuel level.

It is an object of the invention to attain in a candle lamp of the above type a substantially uniform fuel consumption with a generally constant height of flame on the wicks.

According to the present invention a candle lamp having a carrier which floats on liquid fuel and carries one or more non-combustible wicks which in use are partially immersed in the fuel is characterised by the feature that an axial or radial bladed rotor is mounted on the wick carrier and is such that, in use is impacted by the thermal airflow of the burning wick or wicks and acts to rotate the wick carrier.

The constant rotation of the wick carrier with the burning wicks leads to a very uniform consumption of the candle lamp made of wax or a liquid fuel in a corresponding container. The rotating flames impart an appealing and original optical effect.

Depending upon the number and arrangement of the wicks on the wick carrier, a variety of rotors with varying blade designs may be used.

The invention will be described further, by way of example, and in combination with lamp bodies with reference to the accompanying drawings, in which.

Figure 1:
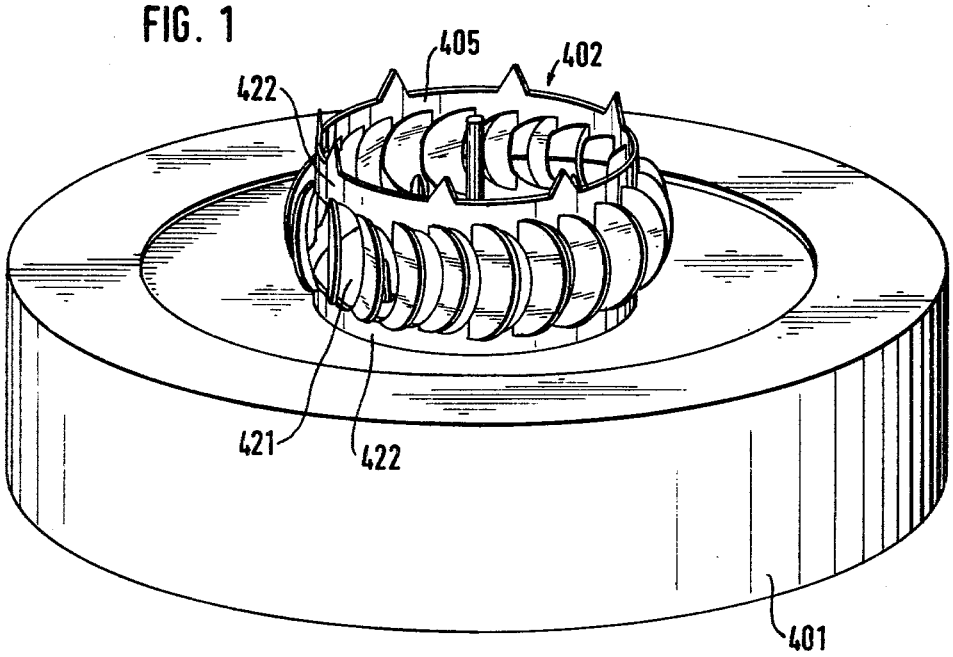
FIG. 1 is a perspective view of a candle lamp having a wick carrier with a rotor thereon.
Figure 2:
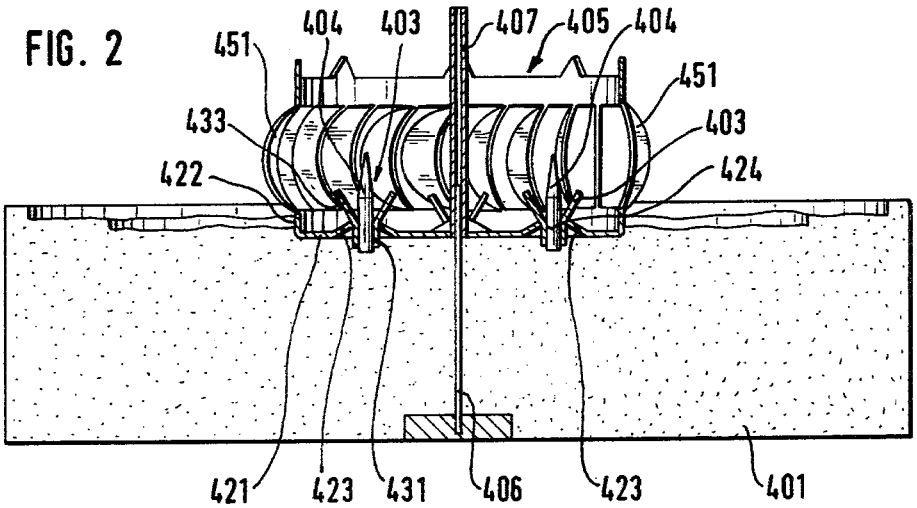
FIG. 2 is a longitudinal section through the lamp of FIG. 1.

Reference is first made to FIGS. 1 and 2. On a wax body 401 a buoyant or floating wick carrier 402 having a flat carrier base 421 is rotatably mounted and centered on an axis or axle 406. In a lateral, carrier edge 422 radial rotor blades 451 are formed from the rotor and denoted as a whole by the numeral 405. The blades are provided with adequate spacing over the wax surface level by crescent-shaped incisions and the sections thus formed are set to extend outwardly in vertical planes.

Several wicks 404 are located inwardly of edge 422 and grouped concentrically on the carrier base 421 with a heat conducting device 403 enclosing it. The heat conducting devices 403 are necessary when solid wax is used as the combustible fuel as such has to be melted in the region of the wick carrier. The heat conducting device 403 shown has flexible heat receiving and transmitting strips 433 located around the wick 404 and by means of which heat is conducted from the flame via the heat conduction strips 431 directly to the wax region around the immersed wick. To prevent liquid wax from entering the carrier 402 the base 421 in the regions of the wicks is elevated by annular rims 423. The heat strips 433 begin above the wick apertures 424.

The outwardly projecting portion of axle 406 may be surrounded with a sleeve 407 formed thereon. After lighting of the wicks 404, the rapid melting of the wax material around the wick is ensured in the starting phase by the heat conducting device 403. After only a short period, a liquid surface forms below the wick carrier 402 on which the carrier floats. An upwardly directed thermal airflow results in cold air being induced through the rotor 405 from the side. This inflowing air acting on blades 451 causes the rotation of the rotor.

Figure 3:
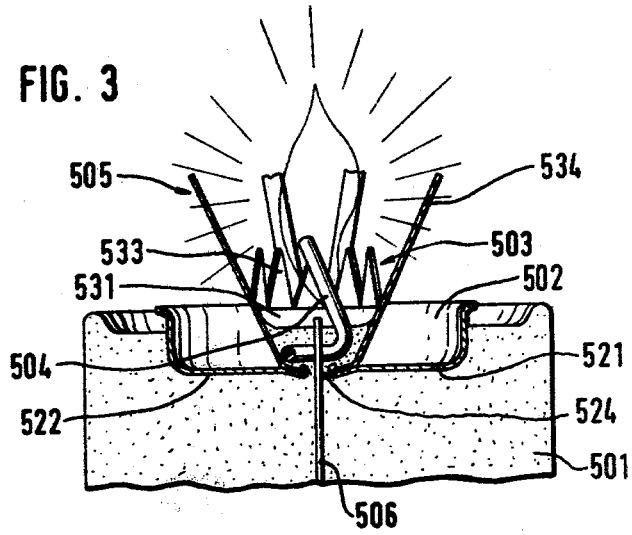
FIG. 3 is a longitudinal section through a candle lamp having a cage-like rotor on a wick carrier and in which a wick is inserted centrally.
Figure 7:
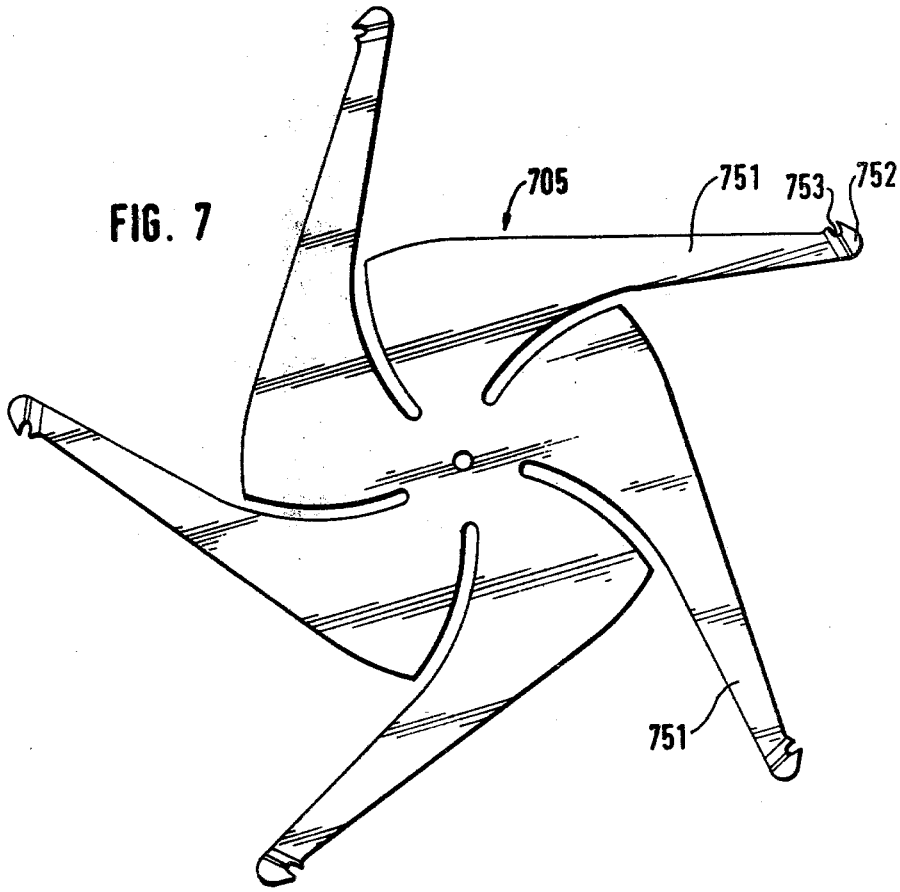
FIG. 7 is a plan view illustrating a development of the cage-like rotor of FIG. 4.

An alternative embodiment of the invention is shown in FIG. 3 wherein the candle lamp has a wick carrier 502 inserted in wax body 501 on a central axle 506 and a rotor 505 is mounted on the wick carrier and which rotor may, for example, have a cage-like form as shown in FIG. 7. The buoyant wick carrier 502 is connected to a generally conical insert 531 which is part of a heat conducting device 503. Axle 506 passes through aperture 524 in the flat carrier base 521 and is anchored in the wax body 501. A wick 504 is located around the axle 506. The heat absorbing strips 533 absorb the radiation heat of the flames. The theoretical edge 534 prevents wax from seeping out of the interior of the insert 531 onto the carrier base 521 which is to be kept clean. To prevent heat from being conducted via the axle into the interior of the wax body it appears expedient to use material which is a bad heat conductor. The axle may be made of combustibly consumable material.

Figure 4:
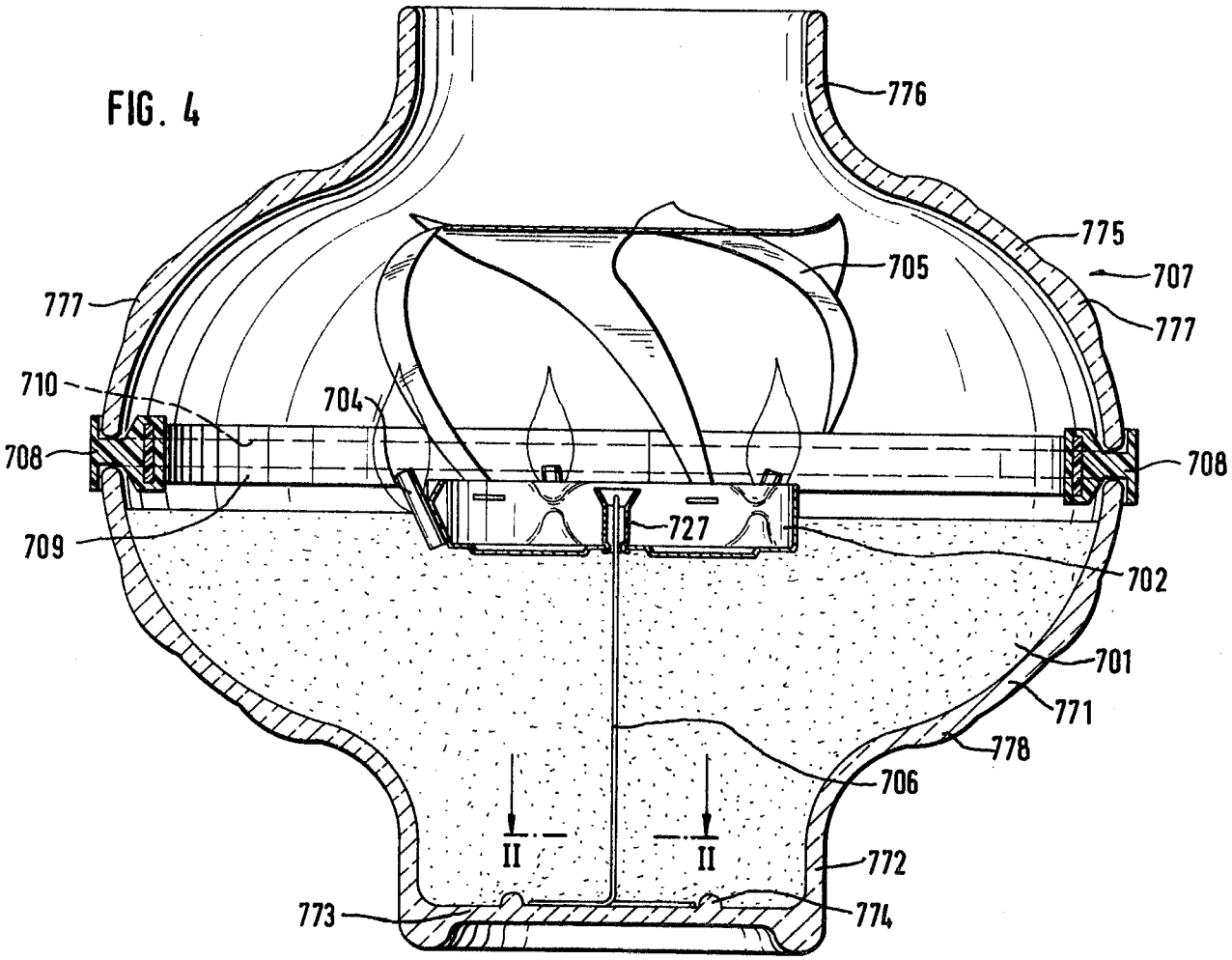
FIG. 4 is a section through a further candle lamp having a horizontally bisected lamp body.
Figure 5:
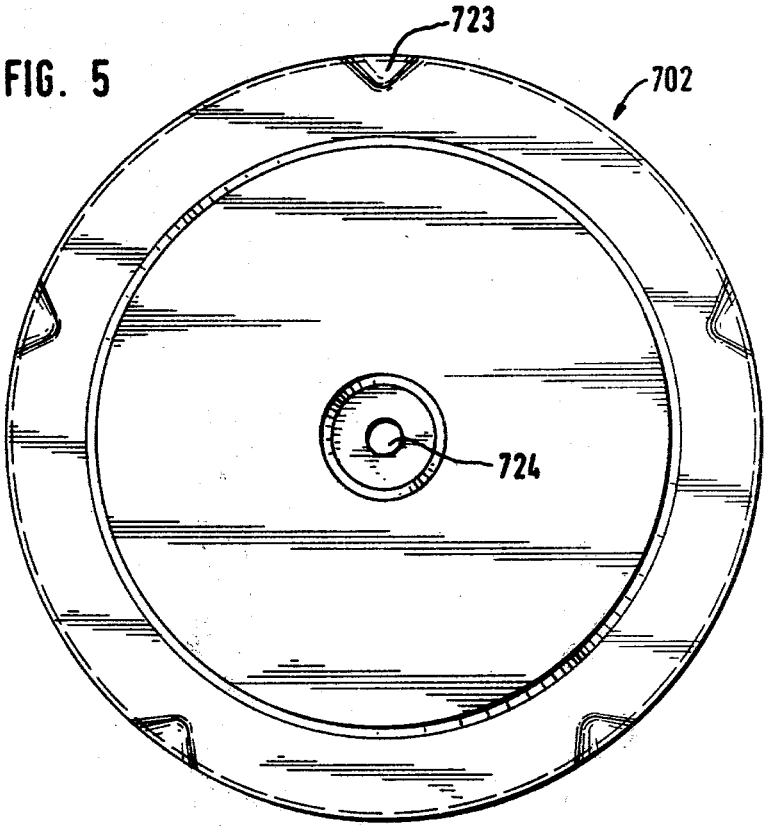
FIG. 5 is a plan of the wick carrier of FIG. 4.

The embodiment according to FIG. 4 comprises a candle lamp having a two-part lamp body 707. The lower part 771 and the lamp base 772 accommodates a wax filling 701. A rotatable wick carrier 702 is mounted centrally of the wax surface on axle 706 and floats on the wax surface on heating thereof. Five wicks 704 are secured to the outside of the raised edge 722 of the wick carrier. Blades 751 of rotor 705 are located over the wicks 704 and mounted on the cage-shaped wick carrier 702. An air gap 710 is formed in the upper part 775 of the lamp by means of spacers of plastics material 708.

This upper lamp part includes an air extraction dome 776 in the manner of a funnel or wind light.

Upon lighting the individual wicks 704 the close proximity of the wicks is rapidly heated. Subsequently the wick carrier 702 is rapidly heated by thermal radiation so that a liquid wax surface forms below the carrier after a short period. The carrier floats freely on the liquid wax and is rotatable about the axle 706. Due to the upwardly directed thermal airflow over the flames around the wicks, the blades 751 of the rotor 705 are impacted and rotate the wick carrier 702 with the wicks and the rotor mounted thereon. The air necessary for combustion and air movement flows through the lateral air gap 710 into the interior of the lamp body. To prevent this relatively powerful air movement from flowing directly to the flames, a plastics material ring 709 is provided which is retained in the spacers 708 and located with spacing from the air gap 710. The ring 709 forms an air deflector so that the air entering does not flow directly towards the flames which would mean the air would not be agitated.

Figure 11:
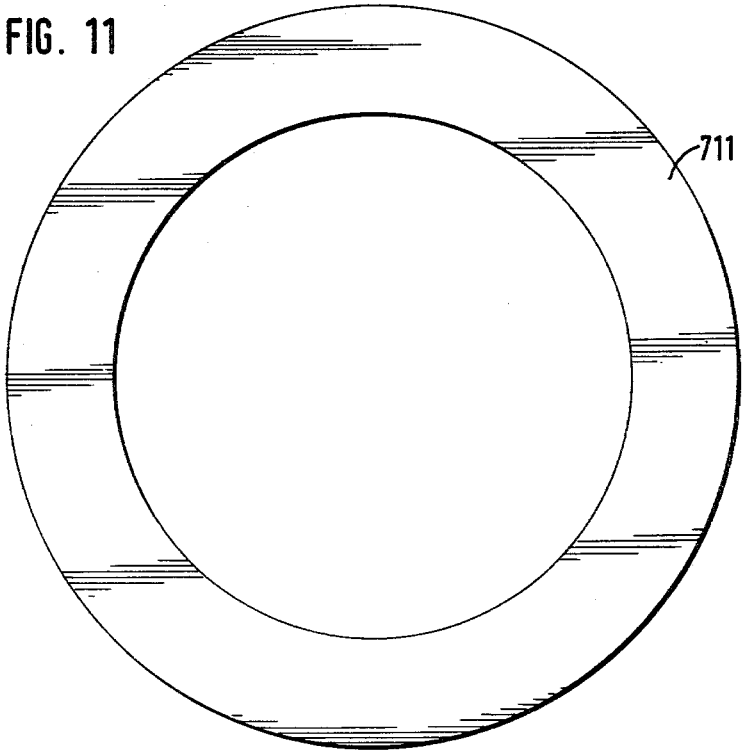
FIG. 11 is a plan view of a wax ring.
Figure 12:
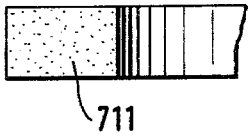
FIG. 12 is a partial cross section of a ring of FIG. 11.

A wax ring is used as refill for the wax reservoir of a candle lamp and is as shown in FIGS. 11 and 12, the inside diameter of which ring is greater than the outside diameter of the heat conducting disc with wicks and heat conducting devices. This wax ring may be simply placed in position in the embodiment after removing the upper part 775 of the lamp.

Figure 8:
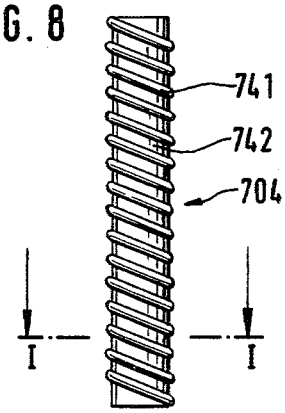
FIG. 8 is an enlarged side view of a wick.
Figure 9:
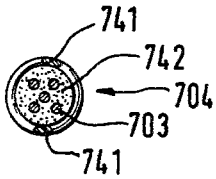
FIG. 9 is a section taken on the line I—I of FIG. 8.

The wick is an important and fundamental component for the permanent function of a candle lamp. According to a preferred embodiment, as shown in FIGS. 8 and 9, a wick 704 comprises a metal wire helix 741 having windings which are mutually spaced apart and retain therein a non-combustible, absorbent wick material 742 of, for example, one or more glass fibres, and continuous metal wires 703 are embedded therein extending parallel to the wick axis and acting as heat conductors.

When producing such a wick heat should reach the close vicinity of the wick quickly after lighting whilst the outer surfaces of the wick have to be accessible to the liquid wax. Excessively fast heat removal must, however, be prevented to permit adequate gasification of the wax material to occur and to prevent sooting. For this reason it is important that the convolutions of the spiral are adequately spaced from each other, the wire thickness being at a corresponding ratio to the diameter of the wick, and that the spiral provides adequate mechanical strength in the entire wick. The strength is necessary so that the wick material can be cleaned-off. The absorbent wick material is not combustible. Wires 703 are embedded therein as heat conductors having an adequate wire cross-section. The cylindrical wick material 742 is flush at the upper end with the spiral convolution or extends slightly therebeyond. To facilitate securing such wicks 704 outside to the raised edge 722 of the wick carrier 704, groove-like notches 723 are provided and conveniently in the regions of inwardly facing bevels 725; said notches forming an adequate abutment surface for the wick 704 by, for example, being cemented-in or by being replaceably mounted. The notches 723 extend right to the carrier base 721. A central bore 724 is formed in the base 721 and over which an axial guide 727 is mounted and through which guide the pivotal axle 706 extends.

Figure 10:
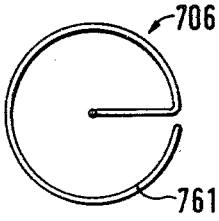
FIG. 10 is a section taken on the line II—II through the axis of the lamp of FIG. 4.

As shown in FIGS. 4 and 10, the pivotal axle 706 is mounted by means of a base foot 761 made of wire resting on the base 773 of the lower part 771 of the lamp and being retained between a single circular bead 774 formed on the base. This arrangement provides centering and simple assembly of the axle in the lower lamp part. It is, however, also possible to secure such an axle to the base of the lower lamp part by means of a sucker whereby the axle may be simply aligned with a lower ball and retained clamped in the suction cup.

The axle design and the external development of the wick carrier with the wick 704 partly recessed in the edge 722 provide for only a low flow resistance during rotation in the liquid wax material. Depending upon the number of wicks or the flames, the size of wick carrier, the design of the rotor and the viscosity of the liquid fuel, a greater or lesser degree of speed of rotation of the wick carrier may be attained. The wicks let into the notches 723 of the raised edge 722 lead to a rapid commencement of rotation of the carrier after the wicks have been lit, since already after the start of melting of the wax directly adjacent to the carrier rotation of the protruding wicks is not obstructed.

Figure 6:
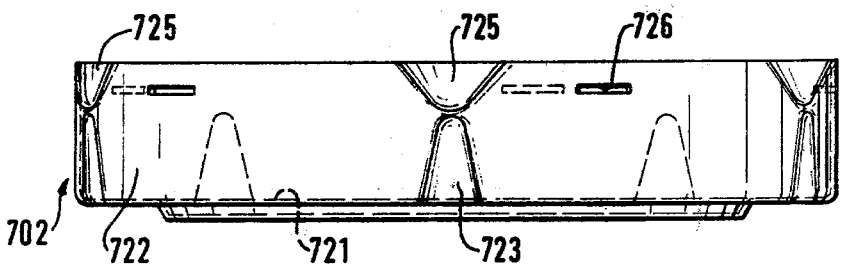
FIG. 6 is a side view of the wick carrier of FIG. 5.

As shown in FIGS. 4, 6 and 7, the curved blades 751 of the cagelike rotor with their angled ends 752 having slots 753 formed therein, are inserted and hooked in slots 726 in the raised edge 722 of the wick carrier 702. This connection is extremly simple and also permits subsequent dismantling, for example, for cleaning.

In the embodiment of FIG. 4 the air conduction in the manner of a wind light has a particular significance. Owing to several flames and the flue action of the air extraction dome 776 a relatively strong airflow occurs. An adequate annular encircling gap 710 is formed for flow of air between the lower part 771 of the lamp and the upper part 775 of the lamp. This annular gap is obtained by spacers 708 which receive the plastics material ring 709. The edges of the lamp parts 771 and 755 thus rest on the web of these spacers.

Such a candle lamp with the still flames slowly rotating presents an optically appealing light source. The charm of such a lamp may be enhanced by light directing or light refracting structural elements on the lamp body. Lenticular structural elements 777 and 778 particularly lead to charming flame images on walls or a ceiling irradiated by the lamp, especially when the focal points of the lenticular structural elements are located on the upper lamp part or the lower part on the circle of wicks or flames. Owing to the rotating flames light effects are obtained which render the lamp especially interesting as a party lamp. Instead of forming light refracting and light directing structural elements thereon, corresponding plastics material rings with such elements may be placed on or mounted on the lamp body, whereby a space is expediently formed between the lamp body and the rings.

Figure 13:
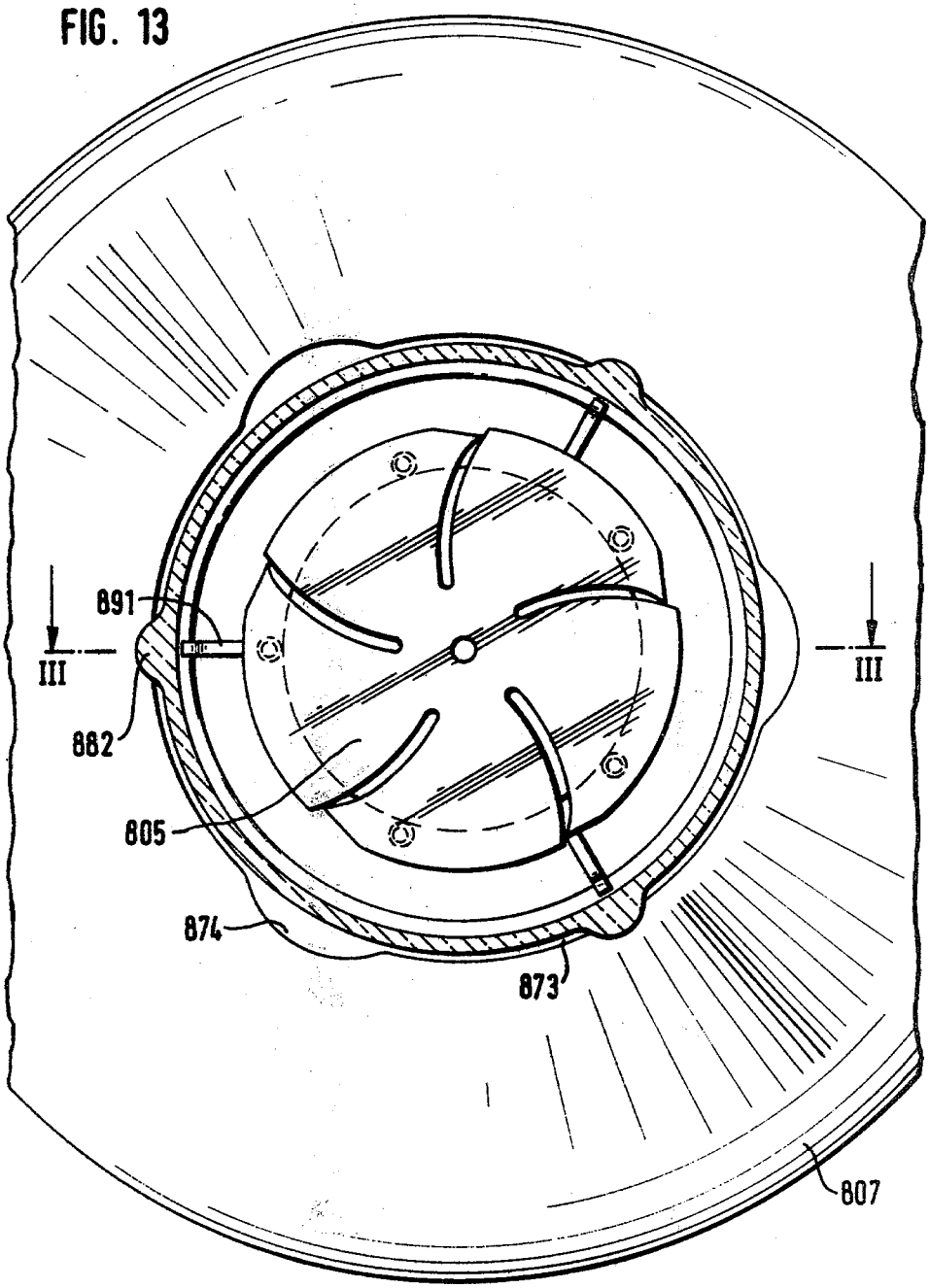
FIG. 13 is a fragmentary plan view of a further candle lamp with liquid fuel.
Figure 14:
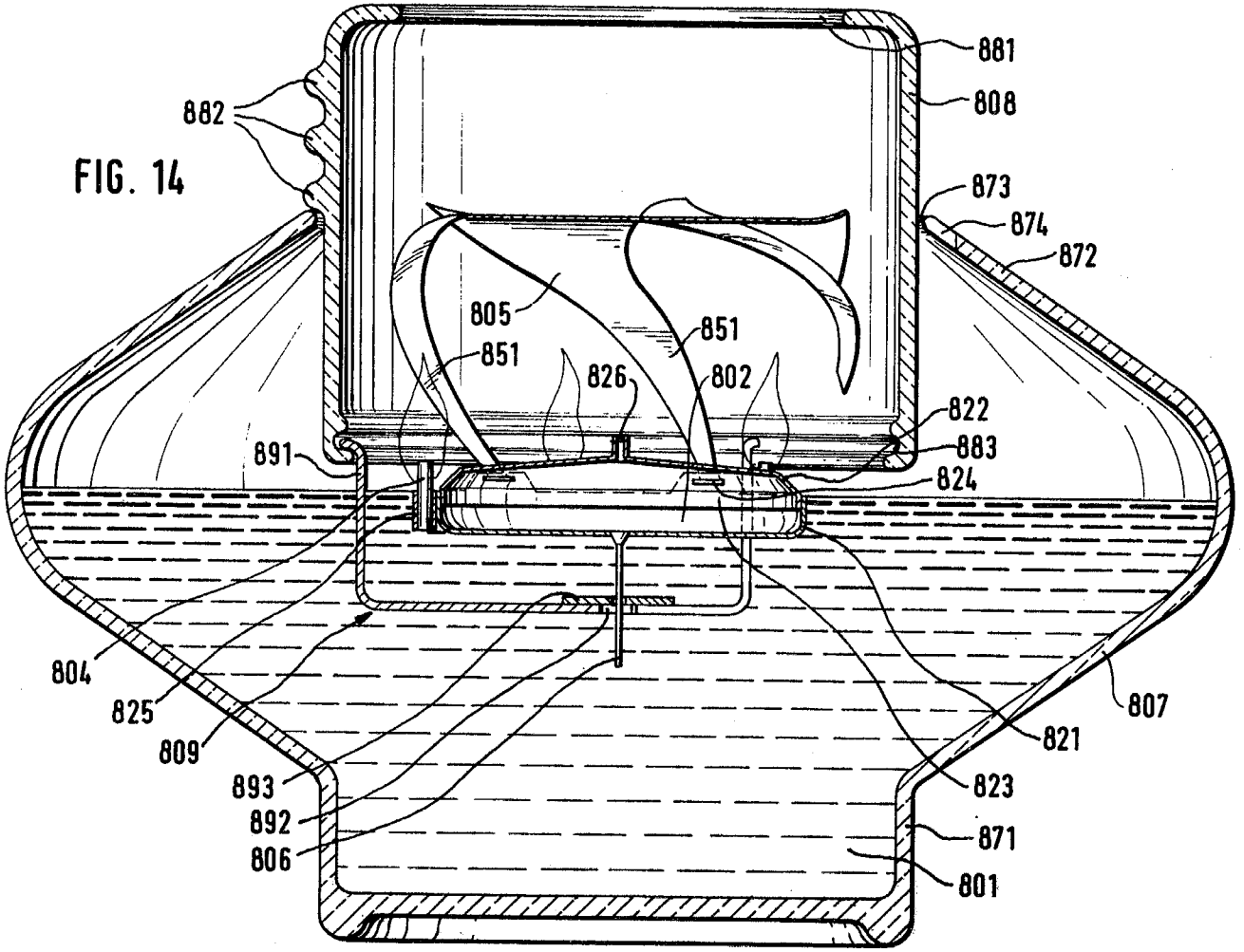
FIG. 14 is a section taken on the line III—III of FIG. 12.

A candle lamp for liquid fuel generally having a lower evaporation point than wax is shown by the candle lamp in accordance with FIGS. 13 and 14. The lamp has an upwardly tapering housing 807 with a base stand 871 and an aperture 872 in the upper conical part 872. It is filled to a suitable level with a liquid fuel, namely liquid paraffin, odourless paraffin or the like. The liquid level of the liquid candle material 801 is indicated in FIG. 13.

On the surface of the liquid there floats a centered rotatably mounted wick carrier 802, and into which, laterally and equidistantly spaced from one another, several wicks 804 in wick holders 825 are inserted. The wick carrier thus comprises of a lower part 821 and a sealed upper part 822 mounted thereon. The axle of rotation 806 is centrally secured to the lower part 821. A rotor 805 is mounted on the wick carrier 802 and blades 851 of the rotor are located over the wicks 804. The ends of the blades 851 are thus hooked replaceably in slots 824 in flaps 823 which project upwardly and are formed on the lower wick carrier part 821. For pressure compensation in the interior of the wick carrier 802 during heating up, upwardly drawn tubular aperture 826 on the upper part 822 is used.

The wick carrier 802 is generally smooth. Its upper part is outwardly inclined from the centre so as to prevent liquid fuel from remaining on the wick carrier, from evaporating during heat development and leading to becoming odorous.

Such hollow wick carriers may be replaced by floats of buoyant material.

A translucent cylinder 808 of suitable material is suspended in the aperture 872 of the lamp body 807 and is vertically adjustable.

For such adjustment several cams 882 are provided in gradation one above the other and located spread around the circumference. Such cams for the adjustment of the cylinder 808 may be replaced by partial thread convolutions which permit a continuous adjustment of the cylinder 808. The cylinder 808, which has an upper aperture 881, is located concentrically over the floating wick carrier 802, whereby its lower edge has sufficient spacing from the liquid surface for supplying air to the wicks 804.

A cage 809 formed by several webs 891 is removably inserted in a lower groove 883 of the cylinder 808. The axle of rotation 806 extends through a bore 892 in the point of intersection of the webs 891. For more accurate centering there is used the mounted centering disc 893.

To light the wicks 804, the cylinder with the cage 809 is removed upwardly from the lamp body 807. The wick carrier 802 is thus also lifted off the cage 809. The wicks, for example, may be replaceably screwed into specially formed wick holders 825, whereby the protrusion of the wicks is adjustable.

After lighting the wicks 804, the cylinder 808 is lowered into the lamp housing 807 and the wick carrier 802 then settles floating on the surface of liquid 801. The cylinder 808 is arranged at a level above the liquid surface wherein its lower edge is located level with the protruding wicks. This vertical arrangement is of particular significance for the supply of combustion air which enters from above through the lateral recess 874 into the lamp body, arrives between the lower edge of the cylinder 808 and the liquid surface at the wicks 804 and rises upwards due to a thermal uplift and the flue effect in the cylinder 808. This rising air together with the combustion gases impacts the blades 851 of the rotor 805 mounted on the wick carrier 802 and causes the wick carrier 802 to be rotated. The height of the flames and the influencing of the air supply by regulating the height of the cylinder 808 over the liquid surface permits the speed of rotation of the wick carrier 802 with its rotor to be affected.

Alternative developments of such a housing are possible. Of particular importance for housing design with liquid fuel is the development of the upper part, since the spilling over of liquid must be prevented even with the slightest movement of the lamp body. Alternative suspension possibilities of the cylinder on the lamp body and the centering cage on the cylinder or on the lamp body are also possible.

Candle lamps of the kind described and claimed in their entity either as a single or several interconnected wax bodies with a mounted rotor or a lamp body filled with liquid fuel may be inserted to float in a liquid container which may preferably be filled with water. These lamps with their rotors driven due to the lighted wicks may be rotated in the liquid container.

I claim:

1. In a wick lamp, a wick carrier adapted to float on liquid fuel and retaining at least one wick which is to be partly immersed in said fuel; a bladed rotor mounted on said wick carrier and arranged to be axially or radially impacted in use by the thermal airflow of each said wick when lighted so as to rotate said wick carrier.

2. A lamp according to claim 1, wherein said wick carrier is centrally mounted on an axle so as to be rotatable thereon.

3. A lamp according to claim 1, wherein each said wick comprises an external metal wire spiral having spaced apart spiral convolutions, surrounding a non-combustible absorbent wick material, and one or more metal heat conductors embedded in the wick material and extending parallel to the wick axis.

4. A lamp according to claim 1, wherein said wick carrier is open at its top and has in the outer edge and spaced above the carrier base, vertically extending outwardly directed radial blades being arranged in a circle.

5. A lamp according to claim 4, wherein several wicks are concentrically grouped in the wick carrier.

6. A lamp according to claim 4, in which said wick is centrally retained in the wick carrier and around which an endless conical ring circle forming a heat conducting device is located with spacing.

7. A lamp according to claim 1, wherein said axially impactable rotor is cage-like and is mounted on said wick carrier and has curved blades with slit inwardly angled ends which are inserted and hooked in position in slots provided in the edge of the wick carrier.

8. A lamp according to claim 1, wherein a lateral edge of said wick carrier groove-like notches for receiving the wicks are provided in the regions of inwardly facing bevels.

9. A lamp according to claim 1, including a lamp body which is translucent and has a lower part which forms a reservoir for fuel and an upper part which is open at the top in the manner of a wind light; and in which lateral air inlet apertures are provided in the lamp body.

10. A lamp according to claim 9, in which several spacers are arranged between upper part and lower part of the lamp body and which retain a concentric ring spaced from said air gap inside the lamp body.

11. A lamp as claimed in claim 9, in which the lamp body is horizontally divided substantially level with the wick carrier, the lower part of which body forms the fuel receptacle and the upper part of which is removably mounted on the lower part with a spacing forming the air gap.

12. A lamp according to claim 9, wherein said lamp body is at least partially formed with light directing and/or light refracting structural elements or covered with corresponding elements.

13. A lamp according to claim 1, in which replaceable wax rings are provided as fuel supply and have an internal diameter which is larger than the external diameter of a wick carrier.

14. A lamp according to claim 1, having a translucent lamp body open at the top and filled with liquid fuel, in which opening a glass cylinder is inserted over the wick carrier and positionable with adjustable spacing over the liquid surface and in which an air inlet is provided in said lamp body.

15. A lamp according to claim 14, wherein said wick carrier has an upper pressure compensation aperture adapted as an endless float.

16. A lamp according to claim 14, in which said glass cylinder is inserted in an upwardly conically tapering part of the lamp body and is supported vertically adjustable with lateral cams formed one above the other on the upper edge of the aperture of the lamp body.

17. A lamp according to claim 5 wherein each said wick has a heat conducting device associated therewith for transmitting heat to melt wax fuel in the region of said carrier.

* * * * *